United States Patent [19]

Marforio

[11] 4,064,818

[45] Dec. 27, 1977

[54] SEWING MACHINE BASE

[75] Inventor: Nerino Marforio, Milan, Italy

[73] Assignee: Rockwell-Rimoldi S.p.A., Milan, Italy

[21] Appl. No.: 716,133

[22] Filed: Aug. 20, 1976

[30] Foreign Application Priority Data

Sept. 11, 1975 Italy ..... 27123/75

[51] Int. Cl.[2] ..... D05B 73/06

[52] U.S. Cl. ..... 112/258

[58] Field of Search ..... 112/258, 63, 215, 216, 112/203, 208, 209, 256

[56] References Cited

U.S. PATENT DOCUMENTS

| | | | |
|---|---|---|---|
| 2,158,562 | 5/1939 | Hacklander et al. | 112/63 |
| 2,219,211 | 10/1940 | Smith et al. | 112/215 |
| 2,623,484 | 12/1952 | Zeier | 112/258 X |
| 3,347,196 | 10/1967 | Leslie | 112/258 |
| 3,363,593 | 1/1968 | Ciecior et al. | 112/209 |

*Primary Examiner*—George H. Krizmanich

[57] ABSTRACT

A sewing machine having a U-shaped base one portion of which defines a unitary tubular element within which the lower stitching instrumentalities and the driving members therefor are housed. The unitary tubular element is formed so as to prevent any possible leakage of lubricant therefrom and includes guides for the feed dog support bars which are externally accessible for the purpose of locating the support bars in their most advantageous operating position as well as to permit simplified replacement thereof.

1 Claim, 4 Drawing Figures

SEWING MACHINE BASE

BACKGROUND OF THE INVENTION

The present invention relates to a sewing machine having a cylindrical base, more particularly, a sewing machine having a U-shaped base housing with one or two feed dog advancement bars which are driven in an alternating longitudinal movement parallel to the axis of the base and in an alternating lifting movement about a pin disposed perpendicular to this axis. The combined action of these two movements serve to advance a workpiece along the base.

In conventional sewing machines, the cylindrical base comprises a substantially U-shaped cross section, which is closed at its upper part by a cover which constitutes the workpiece support surface.

In the aforementioned sewing machine base, the feed dog support bars perform their function between the internal walls and are guided in their movement by portions of these walls, which have been precision-worked.

For this reason, it is obviously necessary to thoroughly lubricate the internal walls and owing to the fact that the base is relatively long, the cover for the upper closure is long, thus resulting in the disadvantage of lubricant escaping at the connection zone between the cover and the surface on which this cover is disposed. In this type of machine, the workpiece is generally in contact with the zone from which the lubricant is escaping, and there is the disadvantage that the workpiece will be soiled relatively easily. A further disadvantage consists in that accurate and thus costly mechanical working is required to prevent leakage of lubricant between the cover and the base.

Another disadvantage results from the fact that, owing to the inevitable wear between the feed dog support bars and the guide walls, it is necessary to replace these bars when the play becomes excessive for the walls in joint are an integral part of the base.

SUMMARY OF THE INVENTION

The object of the present invention is to obviate the above disadvantages and, more particularly, to prevent lubricant from escaping while avoiding the need for mechanical precision working of portions of the base or frequent replacement of the feed dog support bars.

The above object is attained by means of the present invention for sewing machines of the aforementioned type and includes at least one guide means with symmetrically opposite contact surfaces in contact with the feed dog support bars mounted in the base of the sewing machine. This guide means is adjustable with respect to the bars so as to permit compensation of the mechanical play and positioning of the bars per se.

Another feature of the present invention is that the base in which the guide means are disposed, consists of a substantially tubular unitary element and the holders for the guide means are externally accessible for the purpose of adjusting the latter.

The present invention provides the following advantage that no special elements are required in the chamber receiving the feed dog support bars, and consequently, the base can be cast as a unitary tubular element which lacks those troublesome areas from which lubricant can escape. The provision of adjustable guide means makes it possible to retain or replace the bars in their preferred operating position whenever wear develops excessive play. Additionally these guide means are easily replaceable when they become worn.

These and other advantages and features of the present invention will be made apparent in the following description thereof, which is provided with reference to the accompanying drawings, in which:

DESCRIPTION OF THE PREFERRED EMBODIMENT

Figure 1:
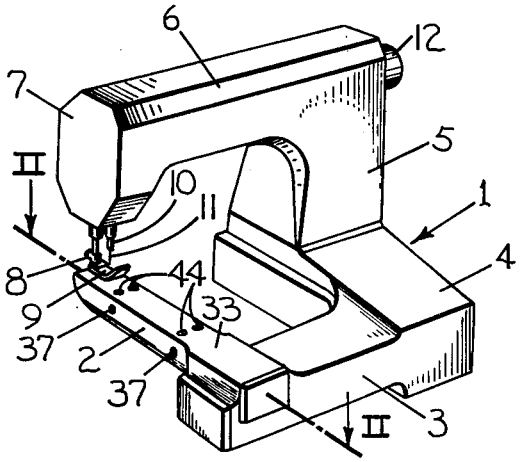
FIG. 1 is a perspective view of a sewing machine.

Referring now to FIG. 1 the invention is mounted on a sewing machine having a U-shaped base consisting of a casing 1 having a base 2 mounted in a projecting manner on a first arm 3 of a support comprising a second arm 4.

The base 2, and the arms 3 and 4 of the support are disposed at right angles to one another so as to form a horizontal essentially U-shaped element.

The casing 1 also includes an upright 5 vertically mounted on the second of the aforementioned arms and on which is mounted a horizontally disposed housing 6 the free end of which defines a head 7 that is located above the free end of the base 2.

The usual pressure device comprisng a presser bar 8 and a presser foot 9 as well as the conventional upper sewing elements including a needle bar 10 and a needle 11, are mounted in the head 7.

The housing 6 houses the drive system for the presser device and the upper sewing elements and includes a handwheel 12 projecting outwardly from one end of said housing.

An elongated unitary body member having a substantially tubular configuration forms the base 2 which houses the drive systems for the conventional lower sewing elements and for the workpiece advancement device.

Figure 2:
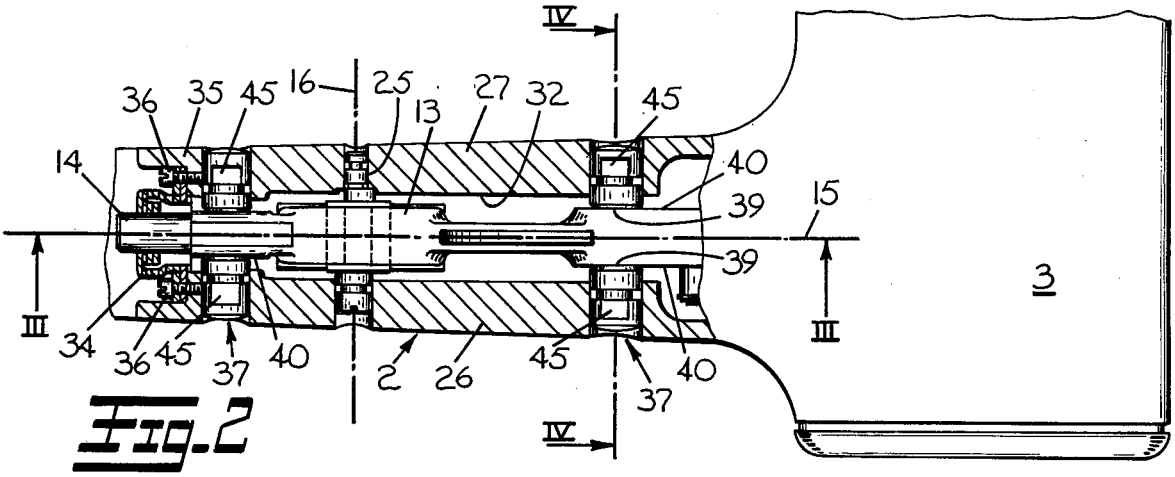
FIG. 2 is a plan view of the base along line II—II in FIG. 1.
Figure 3:
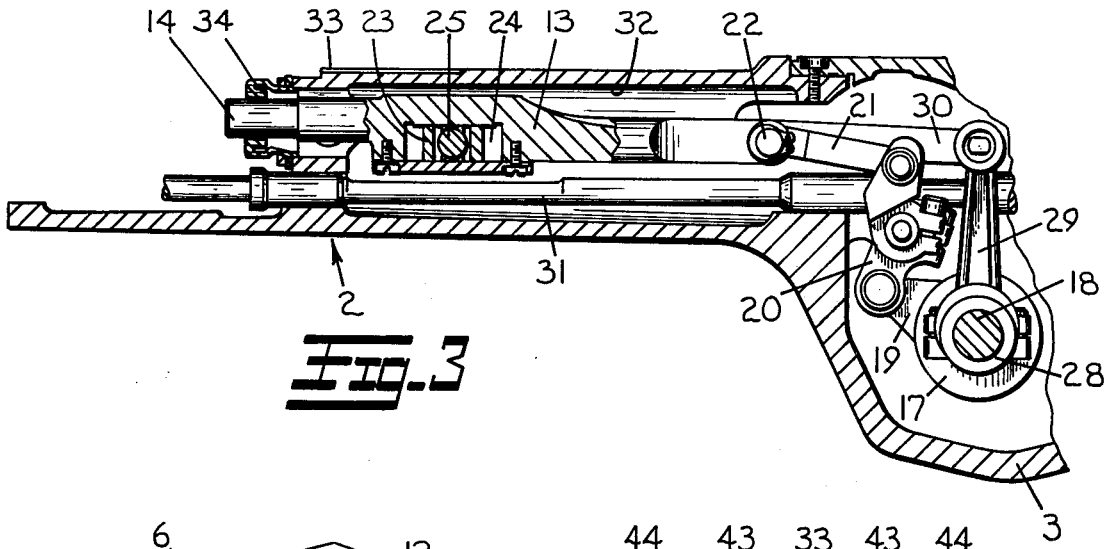
FIG. 3 is an elevational view of the base along line III—III in FIG. 2.

Referring now to FIGS. 2 and 3, the workpiece advancement device which is known per se includes a feed dog support bar 13, the free end 14 of which carries the usual feed dogs (not shown) that serve to advance the workpiece during the sewing operation.

The feed dog support bar 13 is driven in an alternating longitudinal movement parallel to the axis 15 of the base 2 and in an alternating lifting movement about a transversal axis 16 perpendicular to the axis 15.

The alternating longitudinal movement is produced by an eccentric 17, which is regulatable in a conventional manner for the purpose of determining the stitch length and which is fixed on a rotating shaft 18 located in the first arm 3.

A connecting rod 19 is mounted on the regulatable eccentric 17. This connecting rod 19 is pivotally connected to a lever 20 which in turn is pivotally connected to one end of a link 21. The opposite end of link 21 is pivotally connected at 22 to the feed dog support bar 13.

The latter completes the aforementioned longitudinal alternating movement in that it is displaced by a block 23 which is slidably disposed in a groove 24 provided in the feed dog support bar per se, and which is pivotable on a pin 25 that is supported by the opposed walls 26 and 27 of the base 2.

The alternating lifting movement is produced by an eccentric 28 which is fixed on the rotating shaft 18 and to which one end of a connecting rod 29 is operatively attached. The opposite end of this connecting rod 29 is pivotally connected to that end of the feed dog support 13 identified by numeral 30.

The latter completes the alternating lifting movement by rotating about the pin 25 that is supported by the aforementioned block 23.

In the base 2, a control shaft 31 for the conventional hooks of the lower sewing elements (not shown) is provided and is located beneath the feed dog support bar 13.

The feed dog support bar 13 projects from the chamber 32 provided in the base 2 beneath the work surface 33 which hermetically seals this chamber which was cast as a unitary member.

To prevent lubricant from escaping from the chamber 32 in the direction of the above-mentioned lower sewing elements and towards the feed dogs, the free end 14 of the bar 13 is sealed by a flexible packing 34, which is assembled in a conventional manner to the front wall 35 by screws 36 (FIG. 2).

Guide means generally indicated by numeral 37 (FIG. 2) are provided to keep the feed dog support bar 13 correctly positioned within the base 2 and in alignment with the conventional needle plate (not shown) and serves to prevent interference between the feed dogs and the needle plate per se.

Each guide means includes a pair of cylindrical elements 38 comprising a contact surface 39 adapted to adhere to a corresponding number of lateral surfaces 40 provided on the feed dog support bar in symmetrically opposite positions.

Figure 4:
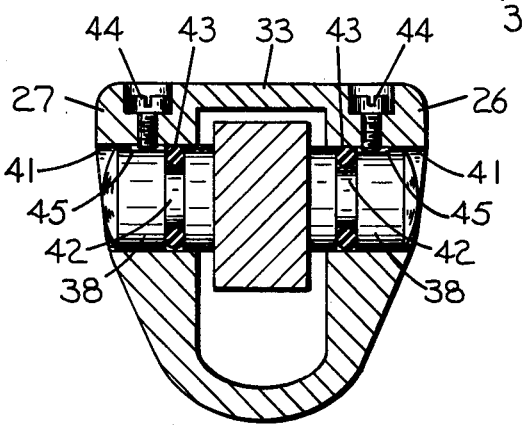
FIG. 4 shows a transversal section of the base along line IV—IV in FIG. 2.

Each of these cylindrical elements 38 is housed in a cylindrical seat 41 (FIG. 4), provided in the walls (26 and 27) in such a way as to be disposed in symmtrically opposite pairs, thus preventing the feed dog support bar 13 from moving away from the axis 15. The cylindrical seats 41 communicate with the outside so as to render the cylindrical elements 38 externally accessible which provides a means for their adjustment.

Each cylindrical element 38 includes an annular groove 42, in which a sealing ring 43 is assembled. The sealing ring 43 conforms to the cylindrical seat 41, and serves to prevent any lubricant from escaping.

The above-mentioned cylindrical elements are held in their set position by means of screws 44, which are assembled in the work surface 33 in a manner whereby the ends thereof engage a surface 45 (FIG. 2) provided on each of said cylindrical elements.

In the embodiment shown, two sets of guide means 37 are provided for the length of the feed dog support bar, specifically in the case of a machine having a U-shapd base, is quite considerable and the thrust action of its control elements develops forces which are a combination of both bending and compression.

As a result of the separation of these guide means 37, which are externally accessible, it is a simple matter to locate the feed dog support bar 13 independently of the shape of the internal chamber 32 of the base.

However, if necessary, two of these bars can be provided in the same chamber without having to replace the base. It is merely necessary to change the position of each cylindrical element 38 within its respective seat 41.

Due to the fact that the cylindrical elements are adjustable within their respective seats, the problem of wear of the moving parts in contact is easily corrected by loosening the associated screws 44 and resetting the cylindrical elements closer to the surfaces 40.

Lastly, as the base is a unitary construction with only the seats 41 communicating with the external surface thereof, the possibility of lubricant escaping is virtually eliminated.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. In a sewing machine having a base within which at least one feed dog support bar is driven to effect actuation of the machine's feed dog and the advance of a workpiece to the stitch forming instrumentalities, said base comprising:

a. an elongated unitary body member (2) of substantially tubular configuration;

b. guide means (37) assembled in said body member (2) for locating the feed dog support bar in a position parallel with the axis of said body member (2) which includes:

i. a pair of cylindrical elements (38) selectively fixed in aligned seats (41) formed in the opposed side walls of said body member (2); and ii. an annular seat (42) formed in each of said cylindrical elements (38) with sealing rings (43) assembled therein having a configuration conforming to said seats (41).

* * * * *